United States Patent [19]

Hori

[11] Patent Number: 4,715,737

[45] Date of Patent: Dec. 29, 1987

[54] PRINTER WITH PAPER FEED ROLLER DISENGAGEMENT MECHANISM

[75] Inventor: Fumihasa Hori, Tamayama, Japan

[73] Assignee: Alps Electric Co., Ltd., Japan

[21] Appl. No.: 511,512

[22] Filed: Jul. 6, 1983

[30] Foreign Application Priority Data

Jul. 7, 1982 [JP] Japan ..... 57-117027
Jul. 7, 1982 [JP] Japan ..... 57-117028

[51] Int. Cl.[4] ..... B41J 19/76

[52] U.S. Cl. ..... 400/569; 400/320; 400/568; 400/634; 400/656; 400/314

[58] Field of Search ..... 400/569, 634, 636, 636.2, 400/641, 654, 655, 656, 568, 320, 314

[56] References Cited

U.S. PATENT DOCUMENTS

| | | | |
|---|---|---|---|
| 547,324 | 10/1895 | Bohannon | 400/569 X |
| 1,683,425 | 9/1928 | Thatcher | 400/569 |
| 1,873,355 | 8/1932 | Stickney | 400/569 |
| 3,260,128 | 7/1966 | Gassino et al. | 400/569 X |
| 3,356,200 | 12/1967 | De George | 400/634 X |
| 3,442,364 | 5/1969 | Ragen | 400/636 X |
| 3,915,281 | 10/1975 | Blomquist et al. | 400/569 |

FOREIGN PATENT DOCUMENTS

| | | | |
|---|---|---|---|
| 0020212 | 12/1980 | European Pat. Off. | 400/569 |
| 0038286 | 4/1981 | Japan | 400/569 |

*Primary Examiner*—Ernest T. Wright, Jr.
*Attorney, Agent, or Firm*—Guy W. Shoup

[57] ABSTRACT

A printer comprises a paper feed roller, an intermediate gear coupled with the paper feed roller and having a spur gear section on an outer circumferential surface thereof, and a paper feed cam having an axis extending perpendicularly to an axis of the intermediate gear and having on its outer circumferential surface a helical tooth for meshing engagement with the spur gear section of the intermediate gear. The paper feed roller is angularly movable for a predetermined angular interval through the intermediate gear in response to angular movement of the paper feed cam. The paper feed cam has in the outer circumferential surface thereof a gap for disengagement with the intermediate gear. The helical tooth has an inclined end edge for guiding meshing engagement with the intermediate gear.

2 Claims, 29 Drawing Figures

Fig.14

| XIV | XIII | XII | XI | X | IX | VIII | VII | VI | V | IV | III | II | I | |
|---|---|---|---|---|---|---|---|---|---|---|---|---|---|---|
| 7 | 8 | 9 | 0 | 1 | 2 | 3 | 4 | 5 | 6 | 7 | 8 | 9 | + | |
| 8 | 9 | 0 | 1 | 2 | 3 | 4 | 5 | 6 | 7 | 8 | 9 | + | − | |
| 9 | 0 | 1 | 2 | 3 | 4 | 5 | 6 | 7 | 8 | 9 | + | − | X | |
| 0 | 1 | 2 | 3 | 4 | 5 | 6 | 7 | 8 | 9 | + | − | X | ÷ | |
| 1 | 2 | 3 | 4 | 5 | 6 | 7 | 8 | 9 | + | − | X | ÷ | = | |
| 2 | 3 | 4 | 5 | 6 | 7 | 8 | 9 | + | − | X | ÷ | = | % | |
| 3 | 4 | 5 | 6 | 7 | 8 | 9 | + | − | X | ÷ | = | % | √ | MG |
| 4 | 5 | 6 | 7 | 8 | 9 | + | − | X | ÷ | = | % | √ | M | |
| 5 | 6 | 7 | 8 | 9 | + | − | X | ÷ | = | % | √ | M | # | |
| 6 | 7 | 8 | 9 | + | − | X | ÷ | = | % | √ | M | # | * | |
| 7 | 8 | 9 | + | − | X | ÷ | = | % | √ | M | # | * | ◊ | |
| 8 | 9 | + | − | X | ÷ | = | % | √ | M | # | * | ◊ | ␣ | |
| 9 | + | − | X | ÷ | = | % | √ | M | # | * | ◊ | ␣ | · | |
| + | − | X | ÷ | = | % | √ | M | # | * | ◊ | ␣ | · | 0 | |
| − | X | ÷ | = | % | √ | M | # | * | ◊ | ␣ | · | 0 | 1 | |
| X | ÷ | = | % | √ | M | # | * | ◊ | ␣ | · | 0 | 1 | 2 | |
| ÷ | = | % | √ | M | # | * | ◊ | ␣ | · | 0 | 1 | 2 | 3 | |
| = | % | √ | M | # | * | ◊ | ␣ | · | 0 | 1 | 2 | 3 | 4 | |
| % | √ | M | # | * | ◊ | ␣ | · | 0 | 1 | 2 | 3 | 4 | 5 | FG |
| √ | M | # | * | ◊ | ␣ | · | 0 | 1 | 2 | 3 | 4 | 5 | 6 | |
| M | # | * | ◊ | ␣ | · | 0 | 1 | 2 | 3 | 4 | 5 | 6 | 7 | |
| # | * | ◊ | ␣ | · | 0 | 1 | 2 | 3 | 4 | 5 | 6 | 7 | 8 | |
| * | ◊ | ␣ | · | 0 | 1 | 2 | 3 | 4 | 5 | 6 | 7 | 8 | 9 | |
| ◊ | ␣ | · | 0 | 1 | 2 | 3 | 4 | 5 | 6 | 7 | 8 | 9 | 0 | |
| ␣ | · | 0 | 1 | 2 | 3 | 4 | 5 | 6 | 7 | 8 | 9 | 0 | 1 | |
| · | 0 | 1 | 2 | 3 | 4 | 5 | 6 | 7 | 8 | 9 | 0 | 1 | 2 | |
| 0 | 1 | 2 | 3 | 4 | 5 | 6 | 7 | 8 | 9 | 0 | 1 | 2 | 3 | |
| 1 | 2 | 3 | 4 | 5 | 6 | 7 | 8 | 9 | 0 | 1 | 2 | 3 | 4 | FG |
| 2 | 3 | 4 | 5 | 6 | 7 | 8 | 9 | 0 | 1 | 2 | 3 | 4 | 5 | |
| 3 | 4 | 5 | 6 | 7 | 8 | 9 | 0 | 1 | 2 | 3 | 4 | 5 | ô | |
| 4 | 5 | 6 | 7 | 8 | 9 | 0 | 1 | 2 | 3 | 4 | 5 | 6 | 7 | |
| 5 | 6 | 7 | 8 | 9 | 0 | 1 | 2 | 3 | 4 | 5 | 6 | 7 | 8 | |
| 6 | 7 | 8 | 9 | 0 | 1 | 2 | 3 | 4 | 5 | 6 | 7 | 8 | 9 | |

PRINTER WITH PAPER FEED ROLLER DISENGAGEMENT MECHANISM

BACKGROUND OF THE INVENTION

The present invention relates to a printer, and more particularly to a serial printer.

Electronic desktop calculators recently available are becoming more and more sophisticated functionally and higher in grade, and also smaller in size and more lightweight. There are also demands for small-size and lightweight electronic desktop calculators equipped with printers for recording calculations as printed data. Therefore, the printers contained in such electronic desktop calculators should also be small in size, lightweight, and of a small power requirement. Printers in electronic devices for general home use are preferably of the matrix printing type since such printers can use a roll of plain paper of a 38-mm or 58-mm width that is readily available and inexpensive and can print data clearly. Such printers are also expected to have a small-size drive source and be less costly.

SUMMARY OF THE INVENTION

It is an object of the present invention to provide a serial printer constructed to meet the conventional demands.

Another object of the present invention is to provide a serial printer capable of stable paper feed operation for equalizing pitches or spaces between adjacent printed lines.

Still another object of the present invention is to provide a serial printer which allows easy attachment and detachment of a sheet of print paper while the print paper is not fed along.

According to the present invention, a printer comprises a paper feed roller, an intermediate gear coupled with the paper feed roller and having a spur gear section on an outer circumferential surface thereof, and a paper feed cam having an axis extending perpendicularly to an axis of the intermediate gear and having on its outer circumferential surface a helical tooth for meshing engagement with the spur gear section of the intermediate gear. The paper feed roller is angularly movable for a predetermined angular interval through the intermediate gear in response to angular movement of the paper feed cam. The paper feed cam has in the outer circumferential surface thereof a gap for disengagement with the intermediate gear. The helical tooth has an inclined end edge for guiding meshing engagement with the intermediate gear.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 14 is a diagram of an arrangement of types in successive character positions.

DESCRIPTION OF THE PREFERRED EMBODIMENT

The present invention is particularly useful when embodied in a serial printer as shown in the accompanying drawings. The components of such a serial printer will be described separately. First, a general construction of the serial printer will be described.

GENERAL CONSTRUCTION

Figure 1:
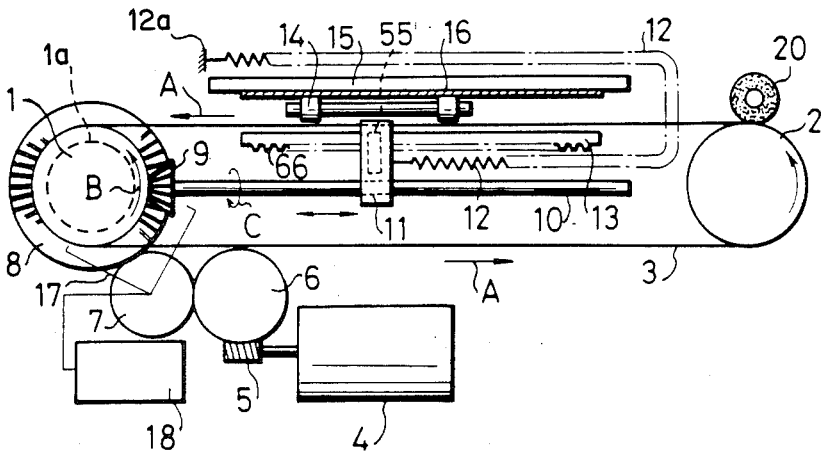
FIG. 1 is a schematic diagram of a general construction of a serial printer according to the present invention.

FIG. 1 schematically illustrates a general construction of a serial printer according to the present invention. The serial printer has a drive pulley 1 and a driven pulley 2 spaced a given interval from each other with an endless type belt or band 3 trained therearound. A DC motor 4 serving as a drive source drives in rotation a worm 5 mounted thereto. Drive power from the motor 4 is transmitted through a pair of first and second idle gears 6, 7 to a main gear 8, from which rotative power is transmitted via a known type of spring clutch 1*a* to the drive pulley 1. The main gear 8 is held in driving mesh with a print/carry gear 9.

To the print/carry gear 9, there is coupled an end of a print/carry shaft 10 extending between the drive pulley 1 and the driven pulley 2 parallel to the type belt 3. A hammer holder 11 is axially slidably mounted on the print/carry shaft 10 and houses a hammer 55 and a carry cam 60 therein as described for FIG. 7 later on. A holder return spring 12 has one end connected to the hammer holder 11 and the other end fixed to a base (denoted in FIG. 1 at 12*a*) such as the printer frame for normally resiliently urging the hammer holder 11 to move to a home position near the driven pulley 2.

A rack 13 is disposed adjacent to and extends parallel to the print/carry shaft 10, the rack 13 having rack teeth 66 meshing with the carry cam 60 accommodated in the rack holder 11. The serial printer also has a paper feed roller 14 and a flat guide plate 15 doubling as a platen. The paper feed roller 14 and the guide plate 15 are positioned behind the rack 13. A sheet of print paper 16 is fed along from below the paper feed roller 14 and the guide plate 15 and guided toward a position adjacent to and outside of the type belt 3. Rotative power from the main gear 8 can be selectively transmitted to the drive pulley 1 or the print/carry gear 9 at suitable timing by a selector lever 17 actuatable by an electromagnetic solenoid 18. An ink roller 20 is rollingly held against the types 21 on the outer peripheral surface of the type belt 3 for coating ink on the type surfaces.

The serial printer of such a general arrangement is capable of performing a series of basic operations including type selecting operation, print/carry operation, and hammer holder return/paper feed operation. These operations are sequentially repeated to print a number of lines on the sheet of print paper 16. The foregoing operations and mechanisms related thereto will be described later. The construction of the type belt 3 will now be described.

TYPE BELT 3

Figure 3:
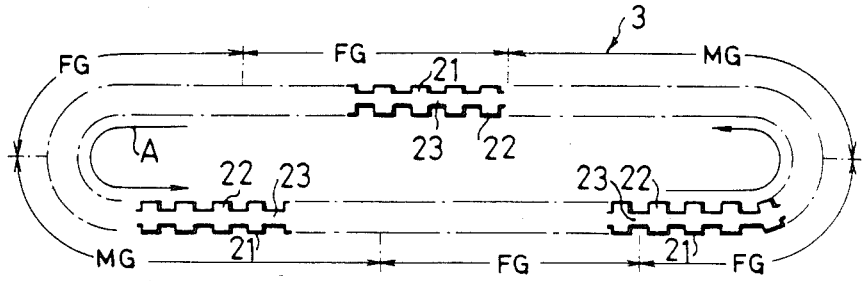
FIG. 3 is a plan view of a type belt used in the serial printer in FIG. 1.

As shown in FIG. 3, the endless type belt 3 has a multiplicity of types 21 spaced longitudinally at prescribed pitches on an outer peripheral surface and a multiplicity of belt teeth 22 spaced longitudinally at prescribed pitches on an inner peripheral surface. The types 21 and the belt teeth 22 are spaced in equal intervals so that they are provided in pairs. The paired types 21 and belt teeth 22 are interconnected by thin connector webs 23. The types 21, the belt teeth 22, and the connector webs 23 are molded of synthetic rubber or synthetic resin having a low degree of polymerization. The type belt 3 therefore has a suitable degree of flexibility, expansibility and resiliency as a whole.

In FIG. 3, the type belt 3 has two type groups having the same type arrangement. Each type group is composed of a symbol type group MG, a numerical type group FG, and another numerical type group FG. The symbol type group MG includes thirteen symbol types such as "+", "−", "×", for example. Each numerical type group FG contains ten numerical types "0" through "9". Therefore, each type group contains a total of thirty-three types 21, and hence the type belt 3 as a whole has a total of sixty-six types 21. With a plurality of such numerical type groups FG that are frequently used, any loss in the time required for type selection can be minimized.

The belt teeth 22 are held in mesh with pulley teeth 24 (FIG. 2) of the drive pulley 1 and the driven pulley 2 for enabling the type belt 3 to travel reliably without slippage. As shown in FIG. 1, the drive pulley 1 is rotated counterclockwise to cause the type belt 3 to run in the direction of the arrow A, so that the type belt 3 will be tensioned along its run facing the sheet of print paper 16 between the driven and drive pulleys 2, 1. The stretch of the type belt 3 which confronts the sheet 16 is prevented from getting slackened, and hence free from large oscillations or wobbling movements in the direction of travel of the sheet 16 even when subjected to more or less vibrations. This allows any characters to be printed accurately in desired positions. There is no danger for the types 21 to be accidentally brought into contact with the sheet 16 in a small-size printer in which the type belt 3 and the sheet 16 are spaced a small distance from each other. A type selection mechanism will then be described.

TYPE SELECTION MECHANISM

Figure 2:
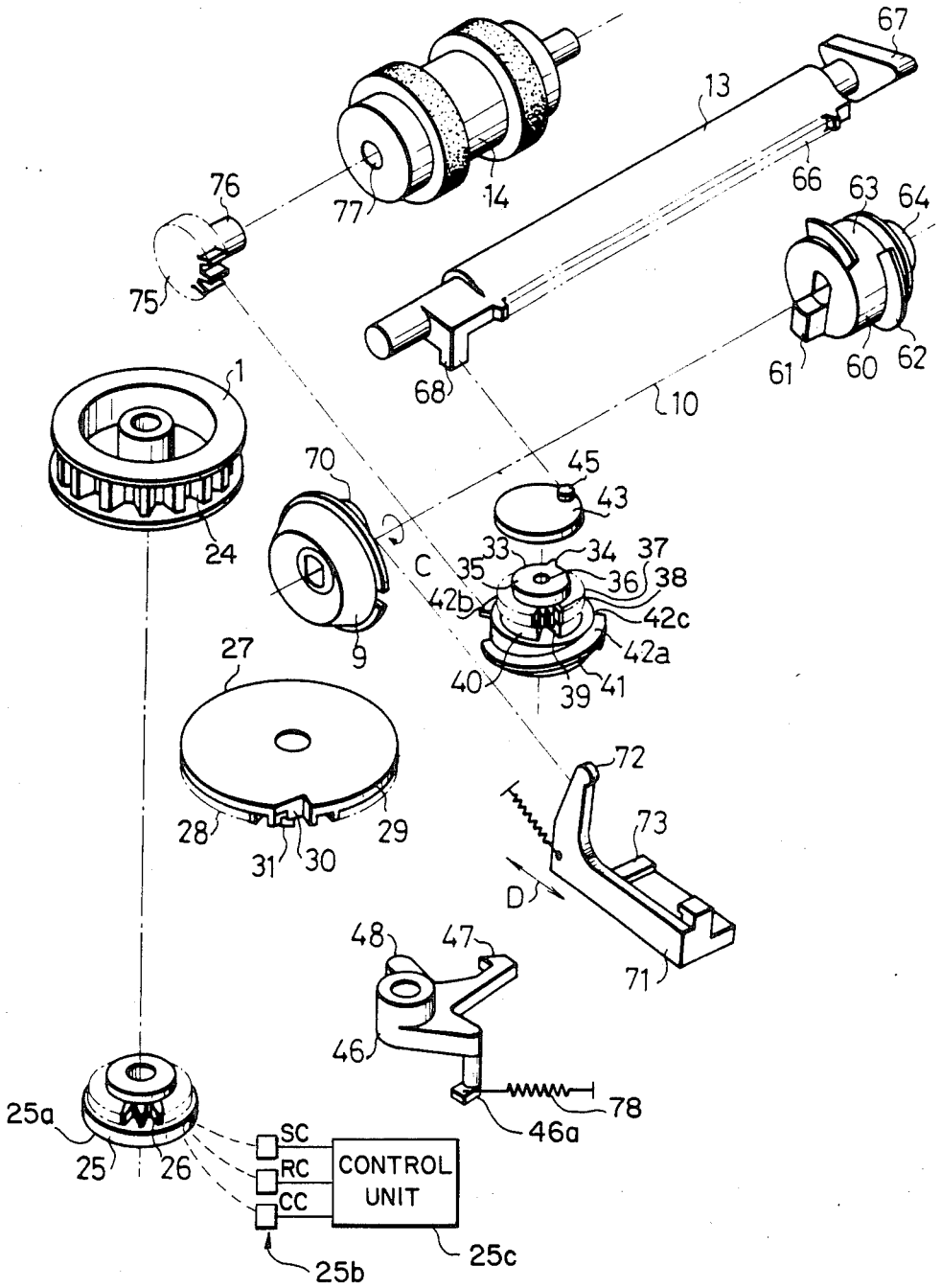
FIG. 2 is an exploded perspective view of components of the serial printer.

First, a mechanism for driving the type belt 3 will be described. As described above, drive power from the DC motor 4 is transmitted through the worm 5, the first idle gear 6 and the second idle gear 7 to the main gear 8. The spring clutch 1*a* of a known construction is interposed between the main gear 8 and the drive pulley 1 for permitting or cutting off power transmission from the main gear 8 to the drive pulley 1. As illustrated in FIG. 2, a code disc 25 is coaxially positioned below the main gear 8 for synchronous rotation therewith. The main gear 8 comprises a bevel gear capable of meshing engagement with the print/carry gear 9.

When the spring clutch 1*a* is connected, power is transmitted from the main gear 8 to the drive pulley 1. When the spring clutch 1*a* is disconnected, the rotation of the drive pulley 1 is stopped and instead power from the main gear 8 is transmitted to the print/carry gear 9 to rotate the latter. This power transmission switching is performed by the selector lever 17 which, for example, may engage or disengage the main gear 8 from the drive pulley 1 or the print/carry gear 9 by respective vertical displacements. Thus, the selector lever 17 is operated to connect the spring clutch 1*a* for rotating the drive pulley 1 in the direction of the arrow B as shown in FIG. 1, whereupon the type belt 3 travels in the direction of the arrow A.

The code disc 25 has an electrically conductive pattern 25*a* attached to the underside thereof and having a predetermined pattern configuration for detecting an angle of rotation of the drive pulley 1, that is, the distance which the type belt 3 has travelled. A plurality of contacts 25*b*, such as a set contact 5*c*, a reset contact RC, and a common contact CC, are resiliently held in contact with the electrically conductive pattern 25*a*. These contacts 25*b* are connected through lead wires to a control unit 25*c*.

Figure 4:
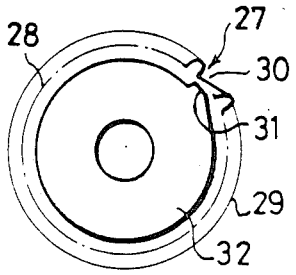
FIG. 4 is a bottom view of a sensor gear.

The code disc 25 has on its upper surface code disc teeth 26 held in mesh with a spur gear section 28 on a sensor gear 27. As shown in FIG. 4, the sensor gear 27 includes a disc 29 disposed above the spur gear section 28 and having the same diameter as the outside circle of the spur gear section 28. The sensor gear 27 has a trigger notch 30 defined in circumferential edges of the spur gear section 28 and the disc 29. The sensor gear 27 also includes a cam disc 32 positioned downwardly of the spur gear section 28 and having a cam projection 31 on its outer peripheral edge.

The number of the code disc teeth 26 is equal to the number of the pulley teeth 24 on the drive pulley 1. The number of teeth in the spur gear section 28 on the sensor gear 27 is equal to the total number of types 21 (one symbol type group MG+two numerical type groups FG) in a single type group on the type belt 3. Therefore, the type belt 3 travels through half of its complete angular path each time the sensor gear 27 makes one revolution.

Figure 5A:
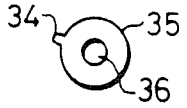
FIG. 5(A) is a plan view of one-tooth member of a control gear unit.
Figure 5B:
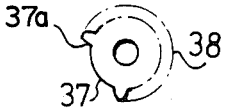
FIG. 5(B) is a plan view of a spur gear of the control gear unit.
Figure 5C:
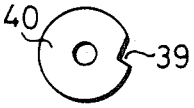
FIG. 5(C) is a plan view of a locking member of the control gear unit.
Figure 5D:
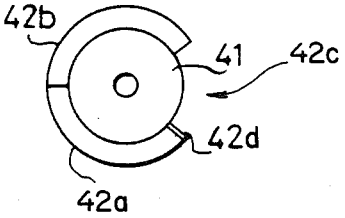
FIGS. 5(D) and 5(E) are plan and side elevational views of a paper feed cam of the gear unit.
Figure 5E:
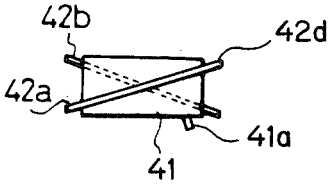

A control gear unit 33 is located adjacent to the sensor gear 27. The control gear unit 33 will be described in detail with reference to FIGS. 5(A) through 5(E). The control gear unit 33 has at its top a one-tooth member 35 having a single tooth 34 on a peripheral edge thereof and a central hole 36. A spur gear 37 is positioned downwardly of the one-tooth member 35 and has a spur gear section 38 including a tooth-free space 37*a* adjacent to the tooth 34 on the one-tooth member 35. The spur gear section 38 is kept in mesh with the spur gear section 28 on the sensor gear 27. A locking member 40 is disposed below the spur gear section 38 and has a single locking notch 39 defined in its outer circumferential edge in substantially diametrically opposite relation to the tooth-free space 37*a*. A paper feed cam 41 is positioned below the locking member 40 and has a diameter slightly larger than that of the locking member 40. The paper feed cam 41 has two helical teeth 42*a*, 42*b* projecting on an outer circumferential surface thereof and extending in diametrically crossing relation as best shown in FIG. 5(E). A gap 42*c* is defined circumferentially between the helical teeth 42*a*, 42*b*. The one-tooth member 35, the spur gear section 38, the locking member 40 and the paper feed cam 41 are integrally molded of synthetic resin.

Figure 10A:
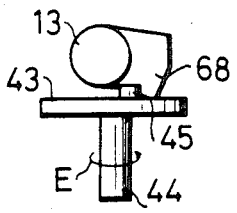
FIGS. 10(A) and 10(B) are side elevational views showing operation of a rack for locking a reset plate against rotation.
Figure 10B:
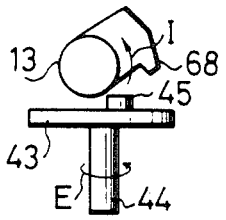

A reset plate 43 is placed above the control gear unit 33 and has a central shaft 44 (FIGS. 10(A) and 10(B)) dependent from the underside thereof and press-fitted in the hole 36 in the one-tooth member 35. Therefore, the reset plate 43 is rotatable with the control gear unit 33. The reset plate 43 has a projection 45 on its upper surface adjacent to an outer peripheral edge thereof.

A pivotable lever 46 has a pawl 47 capable of fitting engagement in the locking notch 39 in the locking member 40. The pivotable lever 46 also includes a cam abutment 48 having a distal end resiliently held at all times against the cam disc 32 of the sensor gear 27. As illustrated in FIG. 2, the pivotable lever 46 has a spring engagement pin 46*a* projecting downwardly from the underside thereof. A tension spring 78 is coupled between the spring engagement pin 46*a* and a pin 41*a* (FIG. 5E) on the paper feed cam 41 for normally urging the control gear unit 33 and the pivotable lever 46 to turn in respective prescribed directions.

For type selection, it is necessary at first to detect a reference position of the type belt 3. In the illustrated embodiment, immediately after the pivotable lever 46 has been angularly moved by the cam projection 31 with rotation of the sensor gear 27, that is, immediately after the pawl 47 of the pivotable lever 46 has been disengaged from the notch 39 in the control gear unit 33, one of the types 21 which bears the number "6" in the second numerical type group (FG) on the type belt 3 is in a position aligned with a hammer 55 (described below for FIG. 7) in the home position. Such a position is selected as a reference position of the type belt 3. With the type belt 3 in the reference position, the distances from the type 21 aligned with the hammer 55 to the other types 21 are known in advance. After the reference position has been detected, the type belt 3 can be moved along until the type 21 as commanded by the control unit 25*c* faces the hammer 55 by detecting the angular displacement of the drive pulley 1 through counting pulses generated by the code disc 25. Since the hammer position is successively varied as character positions vary, the pulses from the code disc 25 are counted taking into account the distance the hammer 55 has travelled to thereby select any desired type 21. A print/carry mechanism will now be described.

PRINT/CARRY MECHANISM

Figure 7:
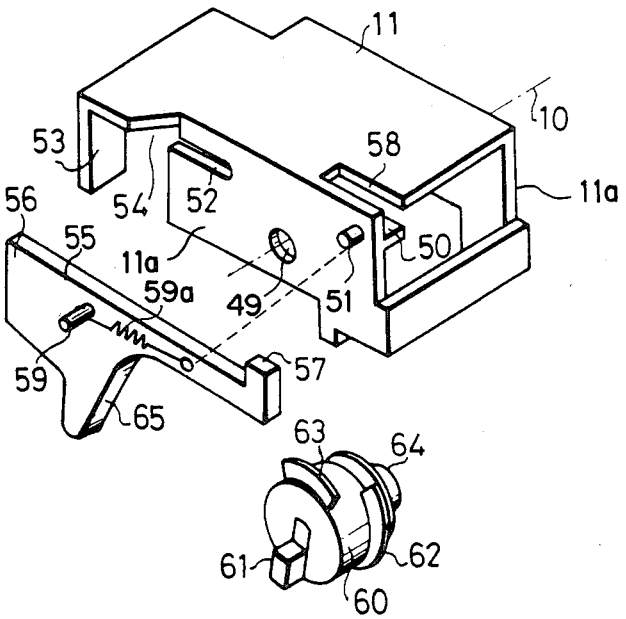
FIG. 7 is a perspective view of a hammer holder, a hammer, and a carry cam.

The hammer holder 11 axially slidably mounted on the print/carry shaft 10 is shaped as shown in FIG. 7. The hammer holder 11 has a pair of side plates 11*a* having holes 49 through which the print/carry shaft 10 is rotatably inserted, and a hammer mount 50 disposed within the hammer holder 11 upwardly of the holes 49 and extending horizontally from a rear end to a front end. One of the side plates 11*a* has a spring engagement pin 51 projecting laterally therefrom and a horizontal slot 52 defined therein in front of the pin 51 and directed toward the pin 51. A pair of laterally spaced partitions 53 are dependent from a front upper edge with an opening 54 defined therebetween which is large enough for one type 21 to project therethrough at a time.

A hammer 55 is placed on the hammer mount 50 and has a front presser 56 positioned in confronting relation to the opening 54. The hammer 55 also includes a rear protuberance 57 projecting upwardly from an upper edge thereof and fitted slidably in a guide groove 58 defined in an upper wall of the hammer holder 11. The hammer 55 also has a spring engagement pin 59 projecting laterally from a side surface thereof cut through the slot 52 in the hammer holder 11. A tension spring 59*a* is connected between the spring engagement pins 59, 51 for normally resiliently urging the hammer 55 rearward in a direction away from the type belt 3. Although not illustrated in FIG. 7, the type belt 3 is arranged to pass through a space defined behind the partitions 53 of the hammer holder 11.

Figure 8:
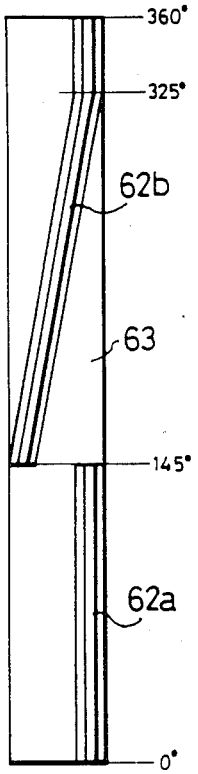
FIG. 8 is a diagram illustrating a cam surface as developed on the carry cam.

A carry cam 60 is mounted in the hammer holder 11 below the hammer mount 50 and splined to the print/carry shaft 10. The carry cam 60 is composed of a hammer driver 61 extending radially outwardly from the center to an outer peripheral surface thereof, a carry cam section 63 having a single ridge 62 extending on an outer peripheral surface thereof, and a rack turn member 64 of an substantially elliptical shape for returning the rack 13. The hammer driver 61 is brought into abutment against a bearing surface 65 of the hammer 55 when the carry cam 60 is rotated. FIG. 8 shows in a developed form the cam surface of the carry cam section 63. The ridge 62 comprises a circumferential ridge member 62*a* extending circumferentially over substantially the half of an entire circumferential surface of the carry cam section 63, and a helical ridge member 62*b* extending helically over the remaining half of the entire circumferential surface of the carry cam section 63, the ridge members 62*a*, 62*b* being contiguous to each other. The ridge 62 is held in mesh with rack teeth 66 (FIG. 2) defined at equal intervals on one longitudinal edge of the rack 13.

Figure 9:
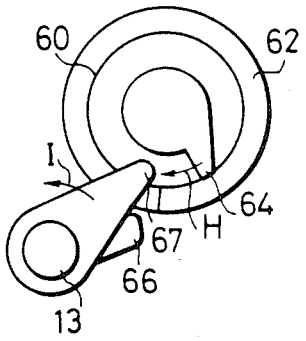
FIGS. 9(A) and 9(B) are plan views explanatory of rack returning movement.
Figure 9:
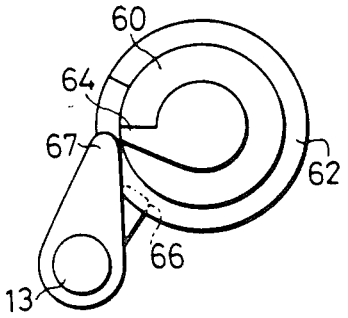

As illustrated in FIGS. 9(A) and 9(B), the rack turn member 64 can abut against a return lever 67 mounted on an end (closer to the home position) of the rack 13 when the carry cam 60 rotates.

Figure 11A:
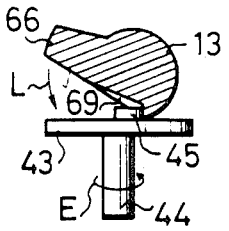
FIGS. 11(A) and 11(B) are cross-sectional views of the rack as it is turned down.
Figure 11B:
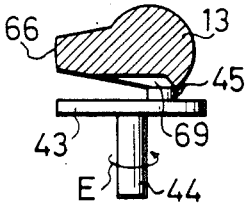

The rack 13 is positioned near the print/carry shaft 10 in parallel relation thereto and angularly movable about its own axis for a predetermined angle. Such angular movement of the rack 13 brings the rack teeth 66 into and out of meshing engagement with the ridge 62 on the carry cam 60. The rack 13 has a stop projection 68 (FIGS. 10(A) and 10(B)) and a turn-down recess 69 (FIGS. 11(A) and 11(B)) formed on an end of the rack 13 remote from the return lever 67. As illustrated in FIGS. 10(A) and 11(A), the stop projection 68 and the turn-down recess 69 can engage the projection 45 on the reset plate 43.

Figure 12A:
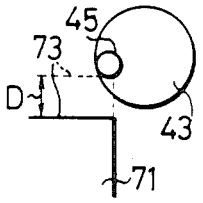
FIGS. 12(A), 12(B) and 12(C) are plan views illustrative of the manner in which a gear clutch lever and the reset plate engage each other.

As shown in FIG. 2, the print/carry gear 9 has on one end surface thereof an elliptical lever pusher cam 70 held at all times in resilient engagement with a distal end surface of an upstanding portion 72 of a gear clutch lever 71. One revolution of the print/carry gear 9 and hence the lever pusher cam 70 in the direction of the arrow C enables the gear clutch lever 71 to reciprocate in the directions of the arrows D. The gear clutch lever 71 has a reset portoion 73 engageable with the projection 45 on the reset plate 43 as illustrated in FIG. 12(A).

When the hammer holder 11 is in the home position under the resiliency of the holder return spring 12 (FIG. 1), the reference position of the type belt 3 is detected as described above with respect to the type selection mechanism. At this time, the rack 13 is turned down as shown in FIG. 9(A), and the rack teeth 66 are held out of mesh with the ridge 62 on the carry cam 60. The reset plate 43 is biasedly coupled urged by a spring (not shown) attached to the control gear unit 33 to turn in the direction of the arrow E (FIG. 10(A)). However, the stop projection 68 on the rack 13 as it is turned down engages the projection 45 on the reset plate 43 to prevent the reset plate 43 and the control gear unit 33 coupled therewith from being rotated.

While the reference position is being detected, the tooth-free space 37*a* in the control gear unit 33 confronts the spur gear section 28 of the sensor gear 27, so that the control gear unit 33 is kept out of mesh with the sensor gear 27. At this time, the cam abutment 48 of the pivotable lever 46 is held against a cam bottom 74 of the cam disc 32 of the sensor gear 27, and therefore the pawl 47 of the pivotable lever 46 is placed in the notch 39 in the control gear unit 47.

Continued rotation of the sensor gear 27 in the direction of the arrow F causes the cam abutment 48 to ride onto the cam projection 31, whereupon the pivotable lever 46 is angularly moved in the direction of the arrow G to force the pawl 47 out of the notch 39 in the control gear unit 33. The control gear unit 33 and the reset plate 43 however remain as they are against rotation since they are engaged by the stop projection 68 as shown in FIG. 10(A). As shown in FIG. 12(A), the gear clutch lever 71 moves back and forth in the directions of the arrows D with the reset plate 43 remaining stopped. Immediately after the cam abutment 48 of the pivotable lever 46 have fallen off the cam projection 31 in response to rotation of the sensor gear 27, the type belt 3 is in its reference position. After the reference position has been detected, type selection is performed. Since the operation of type selection has been described above with respect to the type selection mechanism, it will not be described here. When the cam abutment 48 falls down off the cam projection 31, the pivotable lever 46 is turned in a direction opposite to the direction of the arrow G to allow the pawl 47 to enter the notch 39 in the control gear unit 33.

Selection of any desired type 21 in the first column or home position is followed by printing operation.

Figure 13A:
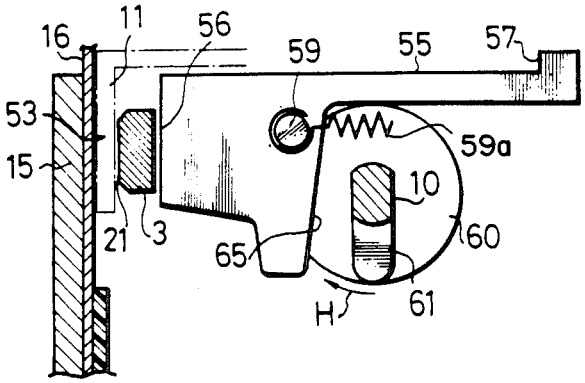
FIGS. 13(A) and 13(B) are side elevational views, partly in cross section, illustrating printing operation.
Figure 13B:
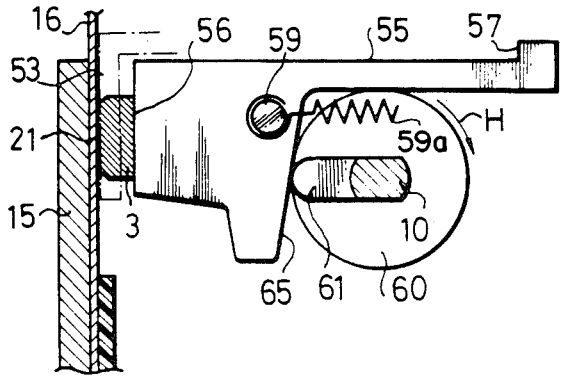

FIGS. 13(A) and 13(B) are illustrative of a cycle of printing operation. The parts positioned prior to the printing operation are shown in FIG. 13(A), while the parts having printed a certain type 21 are illustrated in FIG. 13(B). Prior to the printing operation, as shown in FIG. 13(A), the hammer 55 is shifted rearward under the force of the tension spring 59*a* and positioned by slot 52 (FIG. 7). The type belt 3 is located between the partitions 53 and the front presser 56 of the hammer 55, and is spaced a small distance apart in relation to the front presser 56. The hammer driver 61 is oriented downwardly out of engagement with the bearing surface 65 of the hammer 55.

The print/carry shaft 10 makes one revolution in the direction of the arrow C in response to rotation of the main gear 8. During a front half of such one revolution, the rack 13 is returned and printing operation is effected, and during a rear half, carry operation is continuously performed. More specifically, when the print/carry shaft 10 is rotated in the direction of the arrow C, the carry cam 60 splined to the print/carry shaft 10 is rotated in the direction H in unison therewith. As shown in FIGS. 9(A) and 9(B), during an initial period of rotation of the carry cam 60, the rack turn member 64 kicks up the return lever 67 in the direction of the arrow I, whereupon the rack 13 is returned to bring the rack teeth 66 into mesh with the ridge 62 as shown in FIG. 9(B). In the first half of one revolution, the circumferential ridge member 62*a* (FIG. 8) is in mesh with the rack teeth 66, so that the carry cam 60 and hence the hammer holder 11 with the hammer 55 remain against being laterally shifted while the carry cam 60 rotates through the half revolution. During the half revolution of the carry cam 60, the hammer driver 61 abuts against the bearing surface 65 of the hammer 55 as shown in FIG. 13(B). On continued angular movement of the hammer driver 61, the hammer 55 is pushed forward against the resiliency of the tension spring 59*a*. A selected type 21 confronting the sheet 16 is pushed by the hammer 55 through the opening 54 (FIG. 7) against the sheet 16 to make desired printing thereon. The partitions 53 one on each side of the opening 54 prevent adjacent types 21 from being pressed against the sheet 16. As the carry cam 60 further rotates, the hammer driver 61 angularly moves from the horizontal position (FIG. 13(B)) to an upper position, whereupon the hammer 55 is retracted back out of pushing engagement with the type belt 3 under the force of the tension spring 59*a*. The reciprocating movement of the hammer 55 is properly guided by the hammer mount 50, the protuberance 57 received in the guide groove 58, and the spring engagement pin 59 fitted in the slot 52.

Continued rotation of the carry cam 60 brings the helical ridge member 62*b* (FIG. 8) into mesh with the rack teeth 66 and then shifts the hammer holder 11, the hammer 55, and the carry cam 60 to an upper character position (leftward as shown in FIG. 1).

Figure 6:
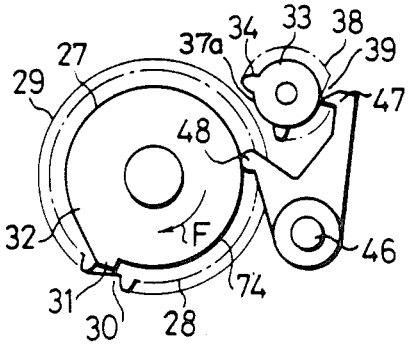
FIGS. 6(A) through 6(E) are plan views showing interengagement between the sensor gear, the control gear unit, and a pivotable lever.
Figure 6:
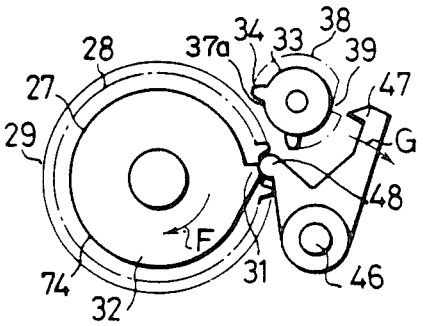
Figure 6:
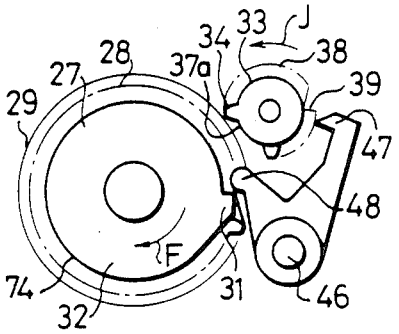
Figure 6:
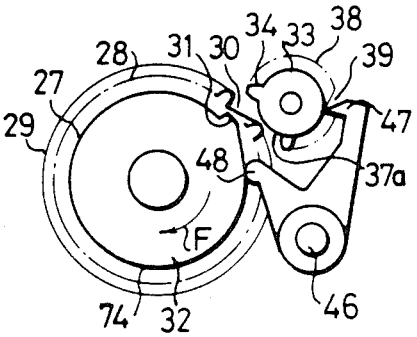
Figure 6:
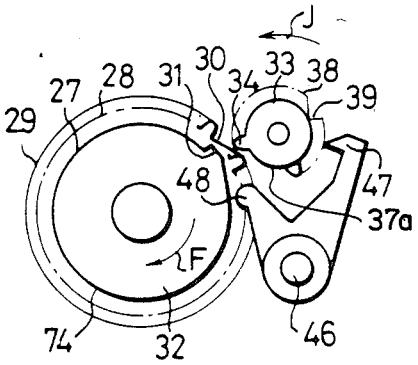
Figure 12B:
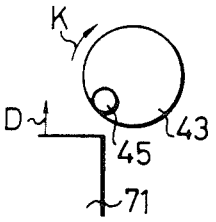

The reciprocating movement of the rack 13, as described above, causes the stop projection 68 on the rack 13 to be disengaged from the projection 45 as shown in FIG. 10(B). Therefore, the control gear unit 33 and the reset plate 43 are prevented from rotation only by the pivotable lever 46. When the cam abutment 48 is caused by the cam projection 31 to move the pawl 47 out of the notch 39 as shown in FIG. 6(B), the control gear unit 33 is slightly turned in the direction of the arrow J under the resilient force of the tension spring 78, previously mentioned, until the tooth 34 on the one-tooth member 35 slidably contacts the outer peripheral surface of the disc 29 of the sensor gear 27, as illustrated in FIG. 6(C). The position of FIG. 6(C) is referred to as a "paper feed set position" in which the projection 45 on the reset plate 43 is positioned as illustrated in FIG. 12(B).

At this time, the trigger notch 30 is positioned for mesh with the tooth 34 of the control gear unit 33 when thirtieth type 21 comes after the cam projection 31 has pushed the cam abutment 48. When even one printing operation is effected during travel of the type belt 3 for thirty characters after paper feed setting, the reset plate 43 is turned in the direction of the arrow K in response to movement of the gear clutch lever 71 in the direction of the arrow D as shown in FIG. 12(B) until the projection 45 is pushed back to the position of FIG. 12(A). Since the pawl 47 of the pivotable lever 46 is resiliently pressed against the outer circumferential surface of the locking member 40 (FIG. 5(C)) of the control gear unit 33, the pawl 47 enters the notch 39 again as shown in FIG. 6(D) when the reset plate 43 is pushed back. No paper feed is then effected since the trigger notch 30 in the sensor gear 27 does not mesh with the tooth 34 when the trigger notch 30 passes below the tooth 34.

The foregoing type selection, printing, carry, and paper feed set and reset operations are successively repeated until desired characters are printed along one line. Then, a hammer holder return/paper feed mechanism will be described.

HAMMER HOLDER RETURN/PAPER FEED MECHANISM

When single-line printing operation has been completed, it is necessary to return the hammer holder 11 back to the home position and also to feed the sheet 16 for a single line spacing in preparation for printing along a next line.

As illustrated in FIG. 2, the helical teeth 42*a*, 42*b* of the paper feed cam 41 are capable of meshing engagement with an intermediate gear 75. The intermediate gear 75 has a coupling shaft 76 press-fitted in a central hole 77 in the paper feed roller 14 for rotation therewith.

When there is no printing operation whatsoever during travel of the type belt 3 for thirty characters after the paper feed setting, the printing operation along the print line is regarded as being finished. When the paper feed setting is effected and then the thirtieth character comes, the tooth 34 of the control gear unit 33 is fitted into the trigger notch 30 in the sensor gear 27, as shown in FIG. 6(E). Then, rotation of the sensor gear 27 causes the spur gear section 28 of the sensor gear 27 to mesh with the spur gear section 38 of the control gear unit 33, whereupon the control gear unit 33 and the reset plate 43 make one revolution.

Figure 15:
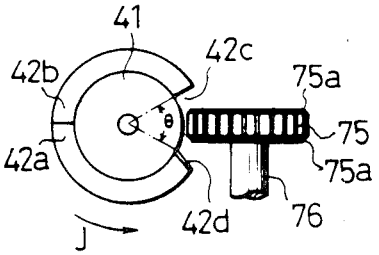
FIG. 15 is a plan view of the paper feed cam and an intermediate gear as they are positioned in confronting relationship.

Before the control gear unit 33 rotates, that is, in modes of operation other than the paper feed operation, the intermediate gear 75 is positioned in the gap 42*c* in the paper feed cam 41 as shown in FIG. 15. During the other operation modes than the paper feed mode, therefore, the intermediate gear 75 and the paper feed roller 14 can rotate freely so that the sheet 14 can be set or removed smoothly and the control gear unit 33 is not positionally displaced.

If the intermediate gear 75 were held in mesh with the helical teeth 42*a*, 42*b* at all times, then the following troubles would result: When the sheet 16 is to be set on the paper feed roller 14, or the sheet 16 is to be detached from the paper feed roller 14, or the sheet 16 as set on the paper feed roller 14 is to be drawn out for a desired length, the control gear unit 33 would be slightly turned through the paper feed roller 14 and the intermediate gear 75. Such angular movement would make less stable the operation of the control gear unit 33 as spring-loaded. Since the paper feed roller 14 remains braked, it would be difficult to handle the sheet 16.

With the gap 42*c* defined between the helical teeth 42*a*, 42*b* for disengagement with the intermediate gear 75, the control gear unit 33 is prevented from being positionally displaced even when the paper feed roller 14 and the intermediate gear 75 are turned at the time of handling the sheet 16, resulting in stable operation of the control gear unit 33.

The size of the gap 42*c* is designed large enough to accommodate the teeth of the intermediate gear 75. It is preferable for the gap 42*c* to provide an angular space of about 60° as shown in FIG. 15.

When the control gear unit 33 is rotated in the direction of the arrow J by meshing engagement between the sensor gear 27 and the control gear unit 33 as shown in FIG. 15, the helical tooth 42*a* is brought into mesh with the intermediate gear 75. Such meshing engagement between the helical tooth 42*a* and the intermediate gear 75 is rendered smooth for the following reasons: The helical tooth 42*a* which is brought into mesh with the intermediate gear 75 at first has an end edge 42*d* that does not extend radially from a base to a distal end of the tooth 42*a*, but that is slightly inclined so that the intermediate gear 75 first meshes with the base of the tooth 42*a* and then with the distal end thereof. The end edge 42*d* is also tapered off. As shown in FIG. 15, the intermediate gear 75 has rounded or bevelled edges 75*a* on both end surfaces thereof.

Figure 12C:
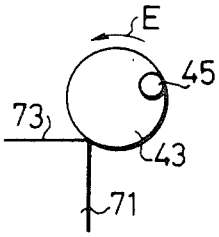

Rotative power from the intermediate gear 75 is transmitted to the paper feed roller 14 to rotate the latter to feed the sheet 16 for a single-line spacing. During such paper feed operation, that is, when the projection 45 on the reset plate 43 makes a substantially half of one revolution as shown in FIG. 12(C), the projection 45 is positioned below the tapered turn-down recess 69 in the rack 13 as illustrated in FIG. 11(A). As the reset plate 43 rotates in the direction of the arrow E, the edge of the rack 13 opposite to the rack teeth 66 is pushed up by the projection 45 entering the recess 69, whereupon the rack 13 is turned down in the direction of the arrow L. When the rack 13 is thus turned down, the rack teeth 66 are brought out of engagement with the ridge 62 on the carry cam 60. The hammer holder 11 with the hammer 55 and the carry cam 60 housed therein is then allowed to return to the home position under the tension of the holder return spring 12.

When the control gear unit 33 makes one revolution, the pawl 47 enters the notch 39, the tooth-free space 37 confronts the sensor gear 27, and the projection 45 on the reset plate 43 is engaged by the stop projection 68 of the rack 13 as shown in FIG. 10(A), thereby readying the parts for printing operation in a next print line.

FIG. 14 shows an arrangement of types 21 in successive character positions. Thirty types 21 encountered after the paper feed setting and before the paper feed operation is started contain all necessary character types 21 in any character position. No printing operation during travel of the type belt 3 for 30 characters after the paper feed setting is regarded as completion of the printing along the print line. Then, the next return and paper feed modes of operation are initiated.

Although in the illustrated embodiment the paper feed roller 14 and the intermediate gear 75 are separate members, they may be integrally formed with each other.

With the arrangement of the present invention, a printer comprises a paper feed roller, an intermediate gear coupled with the paper feed roller and having a spur gear section on an outer circumferential surface thereof, and a paper feed cam having an axis extending perpendicularly to an axis of the intermediate gear and having on its outer circumferential surface a helical tooth for meshing engagement with the spur gear section of the intermediate gear, the paper feed roller being angularly movable for a predetermined angular interval through the intermediate gear in response to angular movement of the paper feed cam, the paper feed cam having in the outer circumferential surface thereof a gap for disengagement with the intermediate gear.

In the printer of such a construction, the paper feed cam and the intermediate gear jointly constitute a worm gearing, and paper feed operation is started before the hammer is returned after the printing operation along one line has been completed. The time required for feeding the print paper can be increased for stable paper feeding operation which allows equalized line spacing. In modes of operation other than the paper feed mode, the intermediate gear is positioned in confronting relation to the gap in the paper feed cam, and hence is held out of mesh with the paper feed cam. Therefore, the print paper can be set or removed with ease, and the paper feed cam is prevented from being positionally displaced for stable operation thereof. Furthermore, the helical tooth of the paper feed cam has an inclined end edge for guiding smooth meshing engagement with the intermediate gear. Accordingly, the printer of the present invention is reliable in operation.

Although a certain preferred embodiment has been shown and described, it should be understood that many changes and modifications may be made therein without departing from the scope of the appended claims.

What is claimed is:

1. A printer comprising a paper feed roller, an intermediate gear coupled with said paper feed roller and having a spur gear section on an outer circumferential surface thereof, and a paper feed cam having an axis extending perpendicularly to a plane including an axis of said intermediate gear and having on its outer circumferential surface a helical tooth for meshing engagement with said spur gear section of the intermediate gear, said paper feed roller being angularly movable in a paper feed mode for a predetermined angular interval through said intermediate gear in response to angular movement of said paper feed cam, said paper feed cam having in the outer circumferential surface thereof a gap for disengagement of said tooth with said intermediate gear in a non-feed mode.

2. A printer comprising a paper feed roller, an intermediate gear coupled with said paper feed roller and having a spur gear section on an outer circumferential surface thereof, and a paper feed cam having an axis extending perpendicularly to a plane including an axis of said intermediate gear and having on its outer circumferential surface a helical tooth for meshing engagement with said spur gear section of the intermediate gear, said paper feed roller being angularly movable in a paper feed mode for a predetermined angular interval through said intermediate gear in response to angular movement of said paper feed cam, said paper feed cam having in the outer circumferential surface thereof a gap for disengagement of said tooth with said intermediate gear in a non-feed mode, said helical tooth having an inclined end edge for guiding meshing engagement with said intermediate gear.

* * * * *